US005186901A

United States Patent [19]

Bayer et al.

[11] Patent Number: 5,186,901

[45] Date of Patent: Feb. 16, 1993

[54] REGENERATIVE BED INCINERATOR SYSTEM

[75] Inventors: Craig E. Bayer; Edward G. Blazejewski, both of Wellsville, N.Y.

[73] Assignee: The Air Preheater Company, Inc., Wellsville, N.Y.

[21] Appl. No.: 445,577

[22] Filed: Dec. 4, 1989

[51] Int. Cl.[5] ..... B01D 53/36

[52] U.S. Cl. ..... 422/111; 110/245; 110/345; 422/177; 422/178; 431/5; 431/170

[58] Field of Search ..... 422/111, 177, 178; 431/5, 170; 110/245, 345

[56] References Cited

U.S. PATENT DOCUMENTS 3,870,474 3/1975 Houston ..... 23/277 C
4,650,414 3/1987 Grenfell ..... 431/5
4,699,071 10/1987 Vier et al. ..... 110/345
4,741,690 5/1988 Heed ..... 431/7

OTHER PUBLICATIONS

Perry, John H., Editor, "Chemical Engineering Handbook," 3rd Edition, 1950, pp. 1625 and 1626.

*Primary Examiner*—Robert J. Warden
*Assistant Examiner*—Timothy M. McMahon
*Attorney, Agent, or Firm*—Paul J. Lerner

[57] ABSTRACT

A regenerative bed incinerator 10 is provided with a gas recirculation duct 80 through which a controlled amount of incinerated process exhaust gases 7 are recirculated to the regenerative bed incinerator 10 to again pass through the combustion zone within the bed 14 housed therein so as to improve overall hydrocarbon destruction efficiency without exceeding permissible temperature limits.

4 Claims, 1 Drawing Sheet

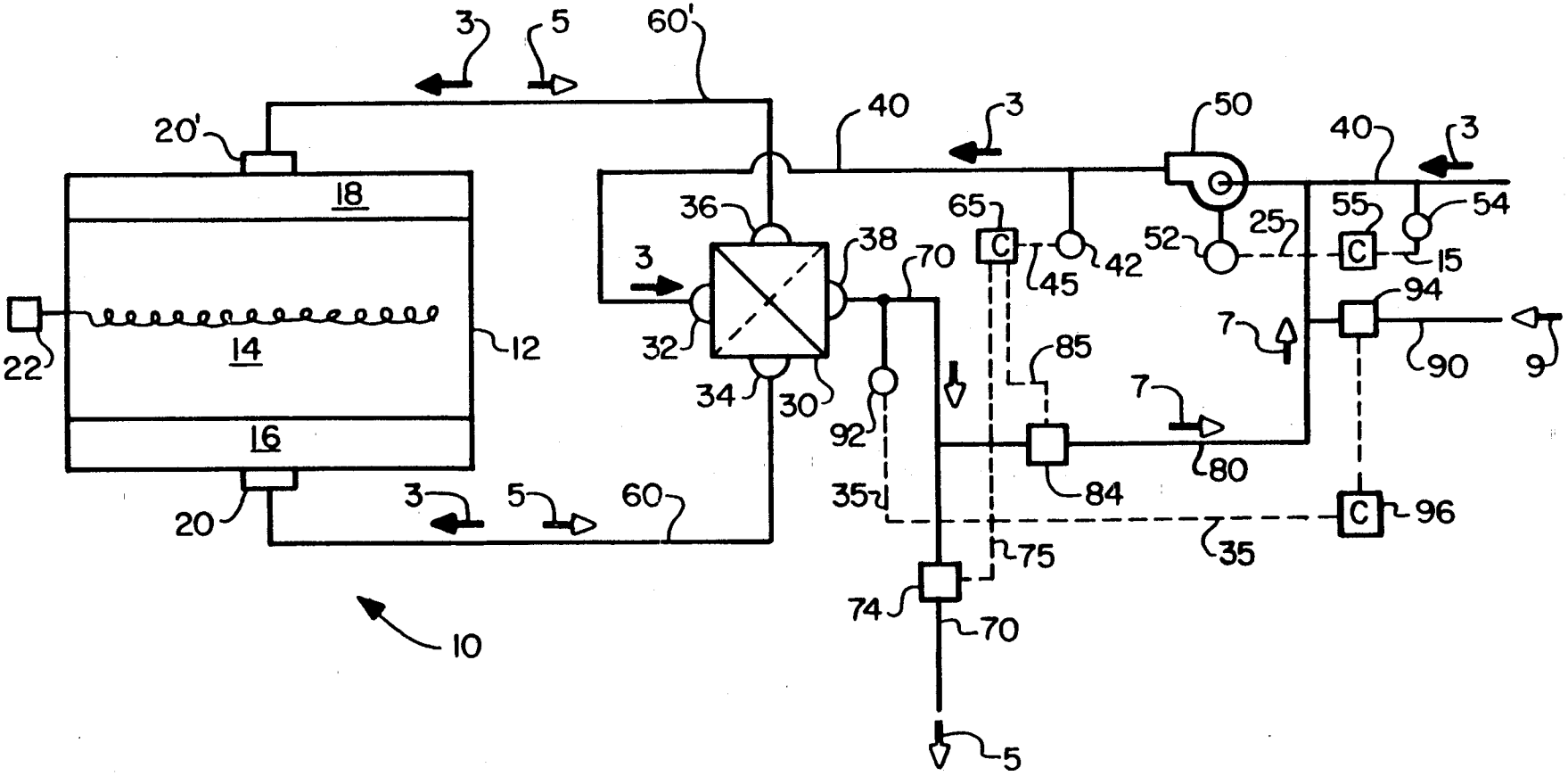
3
54
15
9
90
94
96
40
55
C
C
25
7
50
52
80
35
7
42
84
45
85
75
3
65
C
70
5
40
38
70
92
35
74
30
36
34
60'
32
3
60
5
5
12
3
3
10
18
14
16
20'
20
22

REGENERATIVE BED INCINERATOR SYSTEM

BACKGROUND OF THE INVENTION

The present invention relates generally to the regenerative incineration of solvents and other hydrocarbons in exhaust streams, and more particularly, to a regenerative bed, switching flow-type incinerator for processing waste gas/exhaust air with high hydrocarbon loadings.

Many manufacturing operations produce waste gases or exhaust air which include environmentally objectionable contaminants, generally combustible fumes such as solvents and other hydrocarbon substances, e.g., gasoline vapors, paint fumes, chlorinated hydrocarbons. The most common method of eliminating such combustible fumes prior to emitting the exhaust gases to the atmosphere is to incinerate the waste gas or exhaust air stream.

One method of incinerating the contaminants is to pass the waste gas or exhaust air stream through a fume incinerator prior to venting the waste gas or exhaust air stream into the atmosphere. An example of a suitable fume incinerator for incinerating combustible fumes in an oxygen bearing process exhaust stream is disclosed in U.S. Pat. No. 4,444,735. In such a fume incinerator, the process gas stream is passed through a flame front established by burning a fossil fuel, typically natural gas or fuel oil, in a burner assembly disposed within the incinerator. In order to ensure complete incineration of the combustible contaminants, all of the process exhaust stream must pass through the flame front and adequate residence time must be provided. Additionally, it is necessary to preheat the process exhaust stream prior to passing it through the flame front so as to increase the combustion efficiency. Of course, the cost of the heat exchanger to effectuate such preheating, in addition to the cost of the auxiliary fuel, render such fume incinerators relatively expensive.

Another type of incinerator commonly used for incinerating contaminants in process exhaust streams is the multiple-bed, fossil fuel-fired regenerative incinerator, such as, for example, the multiple-bed regenerative incinerators disclosed in U.S. Pat. Nos. 3,870,474 and 4,741,690. In the typical multiple-bed systems of this type, two or more regenerative beds of heat-accumulating and heat-transferring material are disposed about a central combustion chamber equipped with a fossil fuel-fired burner. The process exhaust stream to be incinerated is passed through a first bed, thence into the central combustion chamber for incineration in the flame produced by firing auxiliary fuel therein, and thence discharged through a second bed. As the incinerated process exhaust stream passes through the second bed, it loses heat to the material making up the bed. After a predetermined interval, the direction of gas flow through the system is reversed such that the incoming process exhaust stream enters the system through the second bed, wherein the incoming process exhaust stream is preheated prior to entering the central combustion chamber, and discharges through the first bed. By periodically reversing the direction of gas flow, the incoming process exhaust stream is preheated by absorbing heat recovered from the previously incinerated process exhaust stream, thereby reducing fuel composition.

A somewhat more economical method of incinerating combustible contaminants, such as solvents and other hydrocarbon based substances, employed a single regenerative bed is disclosed in U.S. Pat. No. 4,741,690. In the process presented therein, the contaminated process exhaust stream is passed through a single heated bed of heat absorbent material having heat-accumulating and heat-exchanging properties, such as sand or stone, to raise the temperature of the contaminated process exhaust stream to the temperature at which combustion of the contaminants occurs, typically to a peak preheat temperature of about 900° C., so as to initiate oxidize the contaminants to produce carbon-dioxide and water. Periodically, the direction of flow of the process exhaust stream through the bed is reversed. As the contaminants combust within the center of the bed, the temperature of the process exhaust stream raises. As the heated exhaust stream leaves the bed, it loses heat to the heat-accumulating material making up the bed and is cooled to a temperature about 20° C. to 25° C. above the temperature at which it entered the other side of bed. By reversing the direction of the flow through the bed, the incoming contaminated process exhaust stream is preheated as it passes that portion of the bed which has just previously in time been traversed by the post-combustion, hot process exhaust stream, thereby raising the temperature of the incoming process exhaust stream to the point of combustion by the time the incoming process exhaust stream reaches the central portion of the bed.

In the regenerative bed heat exchanger apparatus disclosed in U.S. Pat. No. 4,741,690, a heating means, typically an electric resistance heating coil disposed in the central portion of the bed, is provided to initially preheat the central portion of the bed to a desired temperature at which combustion of the contaminants in the process exhaust stream would be self-sustaining. Once steady state equilibrium conditions are reached, the electric resistance heating coil may usually be deactivated as the incoming process exhaust stream is adequately preheated and combustion is self-sustaining due to the gas switching procedure hereinbefore described.

In such systems, it is customary during steady state operation to vent all of the process exhaust stream discharging from the regenerative bed incinerator directly to the atmosphere even though there still may be residual hydrocarbon contaminants therein which escaped incineration or resulted from incomplete incineration. Merely increasing peak combustion temperatures to ensure complete incineration of the contaminants is unacceptable as higher combustion temperatures would necessitate constructing the incinerator housing and associated equipment from more expensive materials.

SUMMARY OF THE INVENTION

The present invention provides an improved regenerative bed incinerator system adapted to improve hydrocarbon destruction efficiency by recirculating a portion of the incinerated process exhaust gases discharging from the regenerative bed incinerator through the combustion portion of the bed again so as to incinerate any contaminants which might have escaped complete incineration on the first pass therethrough and, consequently, were not totally reduced to carbon dioxide and water. A control system is provided which permits the flow to the regenerative bed incinerator of both incoming contaminated process exhaust gases and the total flow gases, that is the overflow flow of incoming contaminated process exhaust gases, recycled incinerated process exhaust gases and tempering air, if any, to be maintained relatively constant.

BRIEF DESCRIPTION OF THE DRAWING

The present invention will be better understood as described in greater detail hereinafter with reference to the sole figure of drawing which illustrates schematically a regenerative bed incinerator apparatus incorporating a system for the recirculation of selective amounts of incinerated process exhaust gases.

DESCRIPTION OF A PREFERRED EMBODIMENT

Referring now to the drawing, there is depicted in FIG. 1 thereof a regenerative bed incinerator 10 incorporating means for selectively recirculating a controlled amount of incinerated process exhaust gases so as to improve overall hydrocarbon destruction efficiency without exceeding permissible equipment temperature limits. It is to be understood that the term process exhaust gases as used herein refers to any process off-stream, be it waste gas or exhaust air, which is contaminated with combustible fumes of an environmentally objectionable nature including, without limitation, solvents, gasoline vapors, paint fumes, chlorinated hydrocarbons and other hydrocarbon substances, and which bears sufficient oxygen, in and of itself or through the addition of air thereto, to support combustion of the contaminants.

The regenerative bed incinerator 10 comprises a housing 12 enclosing a bed 14 of heat accumulating and heat transfer material, a lower gas plenum 16 disposed subadjacent the bed 14, and an upper gas plenum 18 disposed superadjacent the bed 14. Both the lower gas plenum 16 and the upper gas plenum 18 are provided with a gas flow aperture opening 20 and 20', respectively, which alternately serve as gas flow inlets or outlets depending upon the direction of gas flow through the bed, which as will be discussed further hereinafter is periodically reversed.

The bed 14 is comprised of particulate, heat-accumulating and heat-transfer material, such as sand or stone or other commercially available ceramic or metallic material which has the ability to absorb, store and exchange heat and which is sufficiently heat resistant so as to withstand without deterioration the combustion temperatures experienced within the bed. The particulate bed material is loosely packed within the bed 14 to provide sufficient void space within the bed volume such that the process exhaust gases may freely flow therethrough in either direction via a multiplicity of random and tortuous flow paths so that sufficient gas/-material contact is provided to ensure good heat transfer. The particular size of the bed material and gas flow velocity (i.e., pressure drop) through the bed is somewhat application dependent and will vary from case to case. Generally, the bed material will be greater than about two millimeters in its minimum dimension. The gas flow velocity through the bed 14 is to be maintained low enough to preclude fluidization of the particulate bed material.

Preferably, heating means 22, such as an electric resistance heating coil, is embedded within the central portion of the bed 14. The heating means 22 is selectively energized to preheat the material in the central portion of the bed 14 to a temperature sufficient to initiate and sustain combustion of the contaminants in the process exhaust gases, typically to a temperature of about 900° C. Once steady-state, self-sustaining combustion of the contaminants is attained, the heating means 22 is deactivated. Although not generally necessary, the heating means 22 may be periodically reactivated, or even continuously activated at a low level, to provide supplemental heat to the bed 14 to ensure self-sustaining combustion of the contaminants.

Both of the lower and upper gas plenums 16 and 18 are connected in flow communication to valve means 30 which is adapted to receive through the supply duct 40 from the fan 50 incoming process exhaust gases 3 to be incinerated at the first port 32 thereof and selectively direct the received process exhaust gases 3 through either the gas duct 60 which connects the opening 20 of the lower gas plenum 16 in flow communication to the second part 34 of the valve means 30 or the gas duct 60' which connects the opening 20' of the upper gas plenum 18 in flow communication to the third port 36 of the valve means 30. The fourth port 38 of the valve means 30 is connected to the exhaust duct 70 through which the incinerated process gas stream 5 is vented to the atmosphere.

At spaced intervals, typically every few minutes, valve means 30 is actuated to reverse the flow of gases through the bed 14. Thus, every few minutes the role of the lower and upper gas plenums 16 and 18 is reversed with one going from serving as an inlet plenum to serving as an outlet plenum for the incinerator 10, while the other goes from serving as an outlet plenum to serving as an inlet plenum for the incinerator 10. A few minutes later, their role is again reversed. In this manner, the upper and lower portions of the bed alternately absorb heat from the incinerated process exhaust gases leaving the central portion of the bed wherein most of the combustion of the contaminants occurs, and thence give up that recovered heat to incoming process exhaust gases being passed to the bed 14 for incineration.

With the valve means 30 in position A, the incoming process exhaust gases 3 to be incinerated are directed through the first port 32 of the valve means 30 to the second port 34 thereof, thence through gas duct 60 to the lower gas plenum 16 to pass upwardly therefrom through the lower portion of the bed 14 wherein the process exhaust gases are preheated, thence through the central portion of the bed 14 wherein the contaminants therein are incinerated, thence through the upper portion of the bed 14 wherein the incinerated process exhaust gases are cooled by transferring heat to the bed material in the upper portion of the bed, and thence passes into the upper gas plenum 18. The incinerated process exhaust gases 5 are thence passed therefrom through the gas duct 60' to the third port 36 of the valve means 30 and is thence directed through the fourth port 38 of the valve means 30 to the exhaust duct 70 for venting to the atmosphere.

With the valve means 30 in position B, the incoming process exhaust gases 3 to be incinerated are directed through the first port 32 of the valve means 30 to the third port 36 thereof, thence through gas duct 60' to the upper gas plenum 18 to pass downwardly therefrom through the upper portion of the bed 14 wherein the process exhaust gases are preheated, thence through the central portion of the bed 14 wherein the contaminants therein are incinerated, thence through the lower portion of the bed 14 wherein the incinerated process exhaust gases are cooled by transferring heat to the bed material in the lower portion of the bed, and thence passes into the lower gas plenum 16. The incinerated process exhaust gases 5 are thence passed therefrom through the gas duct 60 to the second port 34 of the valve means 30 and is thence directed through the fourth port 38 of the valve means 30 to the exhaust duct 70 for venting to the atmosphere.

In accordance with the present invention, a gas recirculation duct 80 is provided through which a portion 7 of the incinerated process exhaust gases 5 passing through exhaust duct 70 are selectively recirculated back to the inlet side of fan 50 to mix with incoming process exhaust gases 3 and pass again through the bed 14. The gas recirculation duct 80 opens at its inlet end to the exhaust duct 70 at a location upstream of the exhaust gas flow control damper means 74 and opens at its discharge end to the gas supply duct 40 at a location upstream of the inlet of the variable speed fan 50. A recirculation gas flow control damper 84 is disposed in the gas recirculation duct 80 to permit selective control of the flow of the incinerated process exhaust gas 7 through the gas recirculation duct 80.

A static pressure measuring means 54, such as a pitot tube, is disposed in the gas supply duct 40 upstream with respect to gas flow of the location at which the gas recirculation duct 80 opens to the gas supply duct 40 for measuring the static pressure of the incoming process exhaust gas flow. The static pressure measuring means 52 generates a pressure signal 15 indicative of the static pressure of the incoming process exhaust gas flow in the gas supply duct 40 and transmits the pressure signal 15 to a first controller 55 wherein the pressure signal 15 is compared to a desired set point valve of static pressure. In response thereto, the fan controller 55 generates a control signal 25 which it transmits to the fan motor 52 to control the speed of the variable speed fan 50 so as to maintain the flow of incoming process exhaust gases at a preselected level. If the static pressure sensed by the static pressure measuring means 54 drops below the set point static pressure valve, the controller 55 transmits a control signal which increases the speed of the fan 50 to increase the flow of process exhaust gases through the gas supply duct 40 back up to the preselected desired flow rate. Conversely, if the static pressure sensed by the static pressure measuring means 54 rises above the set point static pressure valve, the controller 55 transmits a control signal which decreases the speed of the fan 50 to decrease the flow of process exhaust gases through the gas supply duct 40 back down to the preselected desired flow rate. In this manner, the flow of process exhaust gases through the gas supply duct 40 to the regenerative bed oxidizer 10 is maintained relatively constant at a preselected desired flow rate.

A flow monitoring element 72, such as an anemometer, pitot-tube, venturi meter or the like, is disposed in the gas supply duct 40 downstream with respect to gas flow of the variable speed fan 50 for sensing the flow rate of total gases entering the regenerative bed incinerator 10. The flow monitoring element 42 generates a signal 45 indicative of the overall flow rate of gases passing through the gas supply duct 40 at a location downstream of the fan 50 and upstream of the switching valve means 30. The gas flow in the gas supply duct 40 at this monitoring point is comprised of the contaminated incoming process exhaust gases 3, the recycled incinerated process exhaust gases 7, and the tempering air 9, if any. The signal 45 indicative of the overall flow rate of gases to the incinerator 10 is transmitted from the flow monitoring element 42 to a second controller 65 wherein the measured flow rate indicated by the signal 45 is compared to a preselected set point flow rate. In response thereto, the second controller 65 generates a first control signal 75 which it transmits to the exhaust gas flow control damper means 74 to selectively regulate the flow of the incinerated process exhaust gases 5 vented to the stack through the exhaust gas duct 70, and a second control signal 85 which it transmits to the recirculation gas flow control damper 84 to selectively regulate the flow of incinerated process exhaust gases 7 recycled through duct 80 to the inlet side of fan 50.

If the measured flow rate sensed by the flow monitoring element 42 drops below the desired flow rate represented by the preselected set point flow rate, the controller 65 transits a first control signal 75 which selectively adjusts the damper means 74 to reduce the flow of incinerated process exhaust gases 5 being vented to the stack through duct 70 and a second control signal 85 which selectively adjusts the damper means 84 to increase the flow of incinerated process exhaust gases 7 being recycled to the regenerative bed incinerator 10 through duct 80. Conversely, if the measured flow rate sensed by the flow monitoring element 42 rises above the desired flow rate represented by the preselected set point flow rate, the controller 65 transits a first control signal 75 which selectively adjusts the damper means 74 to increase the flow of incinerated process exhaust gases 5 being vented to the stack through duct 70 and a second control signal 85 which selectively adjusts the damper means 84 to decrease the flow of incinerated process exhaust gases 7 being recycled to the regenerative bed incinerator 10 through duct 80. In this manner, the total flow of gases, that is the sum of incoming process exhaust gases 3, recycled incinerated process exhaust gases 7, and tempering air 9, if any, flows, passing to the regenerative bed incinerator 10 is maintained relatively constant at a preselected desired flow rate.

As noted hereinbefore, tempering air 9 may be added to the incoming process exhaust gases 3 being supplied to the regenerative bed incinerator 10. The purpose of the tempering air 9, which preferably is ambient air, is to reduce the peak temperature produced during combustion of the contaminants within the central portion of the bed 14, and also to reduce the downstream gas temperatures to which the switching valve means 30, fan 50 and the housing 12 are exposed. By reducing these temperatures, less expensive metallic alloys may be employed in construction of these elements and other components of the system.

To regulate the flow of tempering air 9 to the regenerative bed incinerator 10, a temperature sensing means 92, such as a thermocouple, is disposed in the gas exhaust duct 70 for measuring the temperature of the incinerated process exhaust gas 5 at a location downstream of the switching valve means 30. The temperature sensing means 92 generates a temperature signal 35 which is essentially indicative of the temperature of the incinerated process exhaust gas flow leaving the regenerative bed oxidizer 10 and transmits the temperature signal 35 to a tempering air control means 96 which functions to control the amount of tempering air 9 admitted into the recycled incinerated process exhaust gases 7 passing through the gas recirculation duct 80 upstream of the opening of the duct 80 into the process exhaust gas supply duct 40.

The tempering air control means 96 compares the measured temperature indicated by the signal 35 with a preselected set point temperature which represents the maximum gas temperature to be permitted. If the measured temperature exceeds the desired set point temperature, the tempering air control means 96 increases the flow of cool tempering air 9 admitted into the recycled incinerated process exhaust gases. Typically, the tempering air control means 96 would operate to selectively open and close a damper means 94 disposed in the tempering air supply duct 90 at a location near the entrance of the tempering air duct 90 into the gas recirculation duct 80.

It is to be understood that the present invention is not limited to the embodiment described hereinbefore and depicted by the drawing. For example, the exhaust gas recirculation system of the present invention may also be applied to multi-bed regenerative bed incinerators such as, but not limited to, those described in U.S. Pat. Nos. 3,870,474 and 4,741,690 wherein two or more regenerative beds are disposed about a central common combustion chamber. Accordingly, it is intended to include any modifications or variations apparent to those skilled in the art insofar as such modifications or variations fall within the spirit and scope of the invention as delimited by the following claims or the equivalents thereof.

We claim:

1. A regenerative bed incinerator system for treating combustible contaminants in a process exhaust stream, comprising:

a. incinerator means for receiving the contaminated process exhausted stream, preheating the contaminated process exhaust stream, incinerating the combustible contaminants in the preheated process exhaust stream, cooling the incinerated process exhaust stream, and discharging the cooled incinerated process exhaust stream, said incinerator means having at least one gas permeable bed of particulate material having heat-accumulating and heat-exchanging properties disposed therein;

b. gas flow directing means operatively associated with said incinerator means for receiving the contaminated process exhaust stream, directing the contaminated process exhaust stream to and through said incinerator means so as to periodically reverse the direction of gas flow through said incinerator means, receiving the cooled incinerated process exhaust stream from said incinerator means, and discharging the cooled incinerated process exhaust stream;

c. a process exhaust stream supply duct connected in flow communication with said gas flow directing means for supplying a flow of contaminated process exhaust gas thereto;

d. a process exhaust stream vent duct connected in flow communication with said gas flow directing means for exhausting the cooled incinerated process exhaust stream discharging from said gas flow directing means;

e. fan means operatively associated with said supply duct for imparting a pressure boost to the process exhaust stream passing through said supply duct;

f. first gas flow regulation means disposed in said vent duct for selectively regulating the amount of cooled incinerated process exhaust gases exhausting through said first gas flow regulation means;

g. a gas recirculation duct having an inlet opening to said vent duct at a location upstream with respect to gas flow of said first gas flow regulations means and an outlet opening to said supply duct at a location upstream with respect to gas flow of said fan means, said gas recirculation duct providing a flow path for recirculating a portion of the cooled incinerated process exhaust stream;

h. second gas flow regulation means disposed in said gas recirculation duct for selectively regulating the amount of cooled incinerated process exhaust gases recirculated to said supply duct;

i. first control means operatively associated with said first gas flow regulation means and with said second gas flow regulation means for selectively proportioning the flow of cooled incinerated process exhaust stream discharged from said incinerator means through said gas flow directing means into a first portion which is exhausted from the system and a second portion which is recirculated to said supply duct through said gas recirculation duct whereby the flow of gases through said incinerator means is maintained relatively constant.

2. A regenerative bed incinerator system as recited in claim 1 wherein said control means comprises:

a. flow measuring means, disposed in said supply duct at a location upstream with respect to gas flow of said gas flow directing means and downstream with respect to gas flow of said fan means, for determining the gas flow rate through said supply duct and generating a signal indicative of the determined gas flow rate; and b. second control means for receiving the signal indicative of the determined gas flow rate from said flow measuring means, comparing said signal to a preselected set point valve indicative of the desired gas flow rate through said supply duct, and generating and transmitting a first control signal to said first gas flow regulation means and a second control signal to said second gas flow regulation means to selectively operate said first and second gas flow regulation means so as to maintain the gas flow through said incinerator means relatively constant at the desired flow rate indicated by the preselected set point valve.

3. A regenerative bed incinerator system as recited in claim 1 further comprising means for selectively introducing tempering air into said gas recirculation duct to mix with the recirculated cooled incinerated process exhaust stream passing therethrough whereby the peak temperatures experienced in said incinerator means may be controlled.

4. A regenerative bed incinerator system as recited in claim 1 which said fan means comprises a variable speed fan and speed control means operatively associated therewith for selectively regulating the speed of said variable speed fan so as to maintain the flow rate of said contaminated process exhaust stream to said incinerator means relatively constant at a preselected desired flow rate.

* * * * *